US006696944B2

(12) United States Patent
Knittle

(10) Patent No.: US 6,696,944 B2
(45) Date of Patent: Feb. 24, 2004

(54) INDICATING SYSTEM FOR A MANUALLY CONTROLLED APPLICATOR

(75) Inventor: Brett Anthony Knittle, Memphis, IN (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 09/683,609

(22) Filed: Jan. 24, 2002

(65) Prior Publication Data

US 2002/0181995 A1 Dec. 5, 2002

Related U.S. Application Data

(60) Provisional application No. 60/295,694, filed on Jun. 4, 2001.

(51) Int. Cl.[7] ..... G08B 21/00

(52) U.S. Cl. ..... 340/540; 340/691.6; 239/71; 239/74

(58) Field of Search ..... 340/540, 686.5, 340/691.6, 612, 815.4, 815.45, 815.65, 870.02, 870.09; 239/71, 74

(56) References Cited

U.S. PATENT DOCUMENTS

| | | | | |
|---|---|---|---|---|
| 5,064,120 A | * | 11/1991 | Luttrell, Jr. | 239/74 |
| 5,611,784 A | | 3/1997 | Barresi et al. | |
| 5,666,325 A | | 9/1997 | Belser et al. | |
| 5,731,526 A | | 3/1998 | Kindrick | |
| 5,999,106 A | * | 12/1999 | Buckler | 340/870.09 |
| 6,342,264 B1 | * | 1/2002 | Raterman et al. | 427/8 |
| 6,360,143 B1 | * | 3/2002 | Yanagita | 700/245 |
| 6,383,572 B1 | * | 5/2002 | De Graaf et al. | 427/421 |
| 6,391,378 B1 | * | 5/2002 | Carr et al. | 427/8 |
| 6,557,789 B1 | * | 5/2003 | Haas | 239/707 |

* cited by examiner

*Primary Examiner*—Toan Pham
(74) *Attorney, Agent, or Firm*—Raymond L. Coppiellie; Brooks & Kushman, P.C.

(57) ABSTRACT

A method and an assembly 10 for increasing the likelihood that a certain function or operation will be performed in a desired manner. In one embodiment, the assembly 10 measures the amount of material 22 which has been applied to an object 23 and provides several sensory stimulation signals in response to the measurement, effective to provide positive feedback to an operator of the performance of the operation.

9 Claims, 3 Drawing Sheets

INDICATING SYSTEM FOR A MANUALLY CONTROLLED APPLICATOR

CROSS-REFERENCE TO RELATED APPLICATIONS

This application claims the benefit of U.S. provisional application Serial No. 60/295,694 filed June 4, 2001.

BACKGROUND OF INVENTION

The present invention generally relates to an error reduction assembly and to a method for reducing errors in the performance of a certain function or operation and more particularly, to a method and an apparatus for determining whether a certain function or operation has been or is being performed in a desired manner and for providing sensory stimulation signals which are indicative of that determination.

It is frequently required, as part of an overall assembly or manufacturing process, to have operators perform several manual tasks, such as to manually place material, such as an adhesive, upon an object, such as and without limitation a portion of a vehicle. Specifically, in this material deposition operation, it is frequently desired to have only a certain amount of the material deposited upon the object or to have the deposited amount of material fall within a certain predetermined range or deposition tolerance in order to optimally achieve a desired function or goal while minimizing the amount of wasted material, thereby reducing overall cost and producing an item having desired characteristics or attributes.

Due to the vast number of personnel required to typically perform various manual operations within an assembly or manufacturing process and due to the wide dissimilarity of the respective skills of these operators, manual operations, such as placing material upon an object, are often accomplished in an undesirable manner, thereby increasing the overall cost of assembly or manufacturing by causing the production of undesirable items or by requiring certain parts or portions which are used within the assembly or manufacturing process to be discarded as waste and the operation to be again completed with other supplied portions or parts. Moreover, the errant or undesired nature of the operation is typically not discovered (e.g., the operation is not monitored) when it occurs. Rather, undesirable attributes or characteristics of the manufactured assembly or product are typically discovered only after the entire manufacturing or assembly process is completed, thereby further increasing the cost of rectifying these difficulties. It is therefore desirable to allow manual operations to be accurately and desirably accomplished within an overall manufacturing or assembly process, effective to consistently provide or create products having desired characteristics or attributes.

One approach to address these difficulties requires the use of robots or other automated assemblies to replace assembly or manufacturing personnel. While this approach does address the forgoing drawbacks, it requires a relatively large initial capital expenditure and periodic and relatively costly maintenance and repair operations. May of these other strategies also require a relatively large training time, thereby further increasing the overall cost of the manufacturing process. The present invention overcomes some or all of the foregoing drawbacks without the use of robots or other automated assemblies and/or machinery and, by way of example and without limitation, allows an operator to quickly learn the manner in which a certain manual operation is to be performed.

SUMMARY OF INVENTION

It is a first non-limiting advantage of the present invention to provide a method and an apparatus which is adapted to reduce errors within an assembly and/or a manufacturing process and which overcomes some or all of the previously delineated drawbacks of prior strategies and methodologies.

It is a second non-limiting advantage of the present invention to provide a method and an apparatus for allowing a manual operation to be accomplished in a consistently desired manner by a variety of individuals.

It is a third non-limiting advantage of the present invention to provide a method and an apparatus for monitoring the manner in which an operation is being accomplished and for providing a positive feedback signal which is indicative of the manner in which the operation is being accomplished, thereby allowing operators to efficiently learn how to accomplish a certain operation or task in a desired manner while concomitantly reducing the occurrence of errors within the process.

According to a first non-limiting aspect of the invention, an error reduction assembly which monitors the performance of a certain operation is provided. Particularly, the error reduction assembly provides a first indication when the certain operation has been performed in a certain manner and provides a second indication when the certain operation has failed to be performed in the certain manner.

According to a second non-limiting aspect of the present invention, a dispenser assembly is provided and includes a supply of material; a pumping assembly which is coupled to the supply of material; a metering assembly which is coupled to the pumping assembly; an applicator which is coupled to the metering assembly; and a display assembly which is coupled to the metering assembly, which determines whether at least a portion of the supply of material has been dispensed in a desired manner, and which provides a positive indication of the determination.

According to a third non-limiting aspect of the present invention, a method for increasing the likelihood that an amount of material residing within a certain predetermined range will be deposited upon a portion of a vehicle is provided. Particularly, the method includes the steps of depositing material upon the portion of the vehicle; measuring the deposited material; and providing a sensory stimulation signal when the amount of the deposited material is outside the certain predetermined range; and providing a second sensory stimulation signal when the amount of the deposited material is within the certain predetermined range.

These and other features, aspects, and advantages of the present invention will become apparent upon a reading of the following detailed description of the preferred embodiment of the invention and by reference to the following drawings.

DETAILED DESCRIPTION

Figure 1:
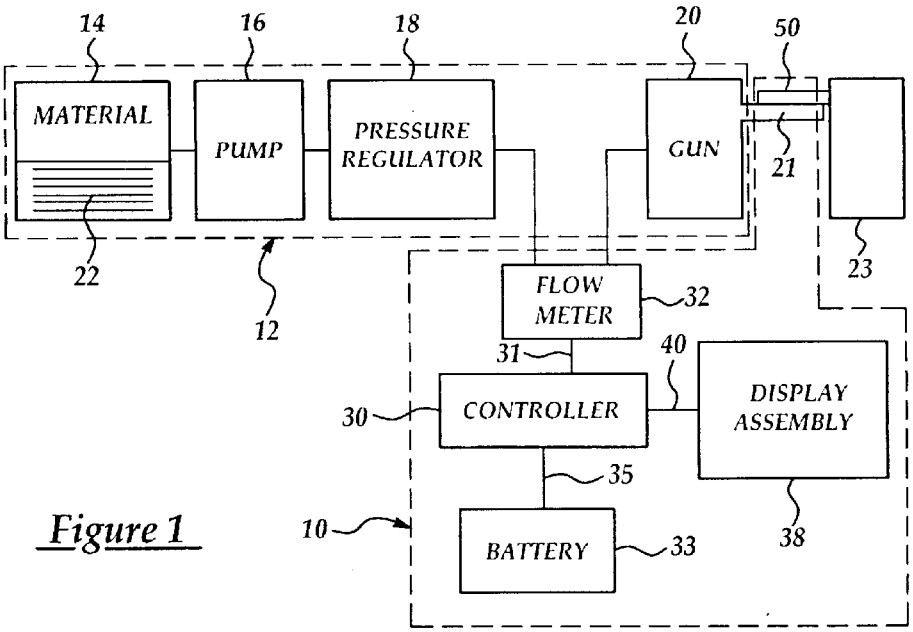
FIG. 1 is a block diagram of an error reduction assembly, which is made in accordance with the teachings of the preferred embodiment of the invention and which is shown in operative combination with a material dispenser assembly.
Figure 2:
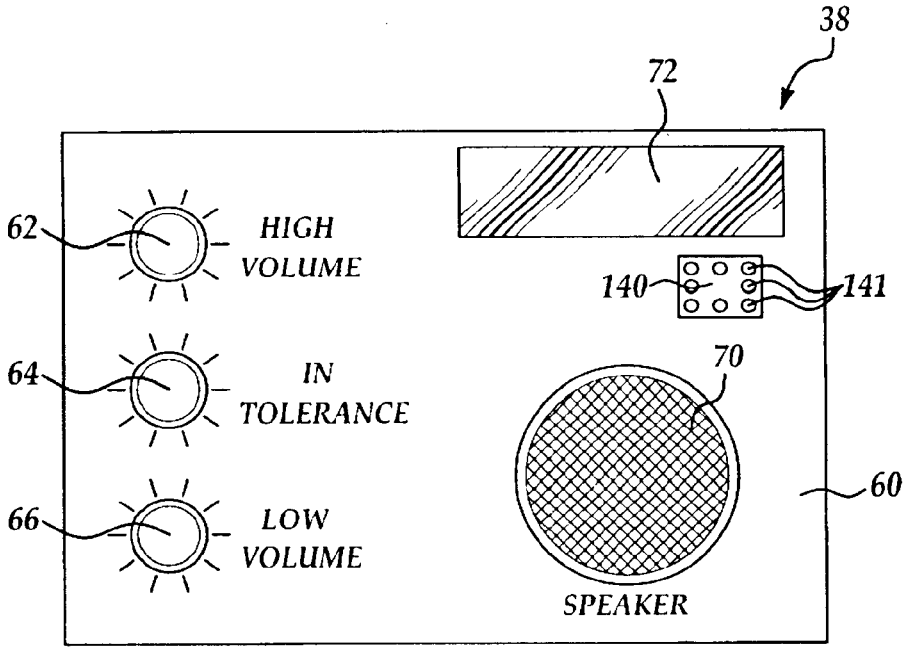
FIG. 2 is a front view of the display assembly, which is made in accordance with the teachings of the preferred embodiment of the invention and which is shown in FIG. 1.

Referring now to FIGS. 1 and 2, there is shown an error reduction assembly 10 which is made in accordance with the teachings of the preferred embodiment of the invention in combination with a material dispensation assembly 12 including a source of material 14 having material 22 which may comprise an adhesive, a pump 16 which is coupled to the source of material 14, a pressure regulator 18 which is coupled to the pump 16, and a gun or material dispenser 20 which is normally and directly coupled to the pressure regulator 18 and/or to the pump 16. As shown, gun or material dispenser 20 includes a nozzle 21 and a guard or guide member 50 which is attached to the nozzle 21 or the body of the gun 20, which is parallel to the nozzle 21, and which protrudes from the body of the gun 20 at a longer or greater distance than does the nozzle 21.

In normal or typical operation, a selective depression of a switch (not shown), which may be disposed upon the pump 16, causes the pump 16 to be activated or energized and causes material 22 to be communicated from the material source 14 to the pressure regulator 18 and to the gun 20. A depression of the gun 20 (e.g., a depression of the handle of the gun 20 (not shown)) allows the communicated material 22 to be selectively deposited upon a portion of an object or assembly, such as but not limited to a portion of a vehicle 23, through the extended nozzle 21. The regulator 18 conventionally or typically ensures that a substantially steady amount of pressure occurs between the material source 14 and the gun 20 as the material 22 is being supplied to the gun 20. The typical or conventional operation of the material dispensation assembly 12 is modified by the error reduction assembly 10 in the manner which is more fully set forth below and in accordance with the teachings of the invention. At the outset, as should be realized from the following discussion, the principles of the present invention may be used in a wide variety of manual processes or operations and that the present invention is not limited to a material deposition process.

Error reduction assembly 10 includes a controller 30 which is operable under stored program control and which may comprise, in one non-limiting embodiment, a programmable logic controller assembly. Error reduction assembly 10 further includes a flow meter 32 which is coupled to the pressure regulator 18 and to the gun 20 and which is further coupled to the controller 30 by the use of bus 31. Error reduction assembly 10 further includes a source of electrical power or a battery 33 which is coupled to the controller 30 by the use of bus 35 and a display or sensor stimulation signal output portion 38 which is coupled to the controller 30 by the use of bus 40. It should be realized that the term battery as used in the remainder of this description may refer to battery 33 or to any other source of electrical energy.

Figure 3:
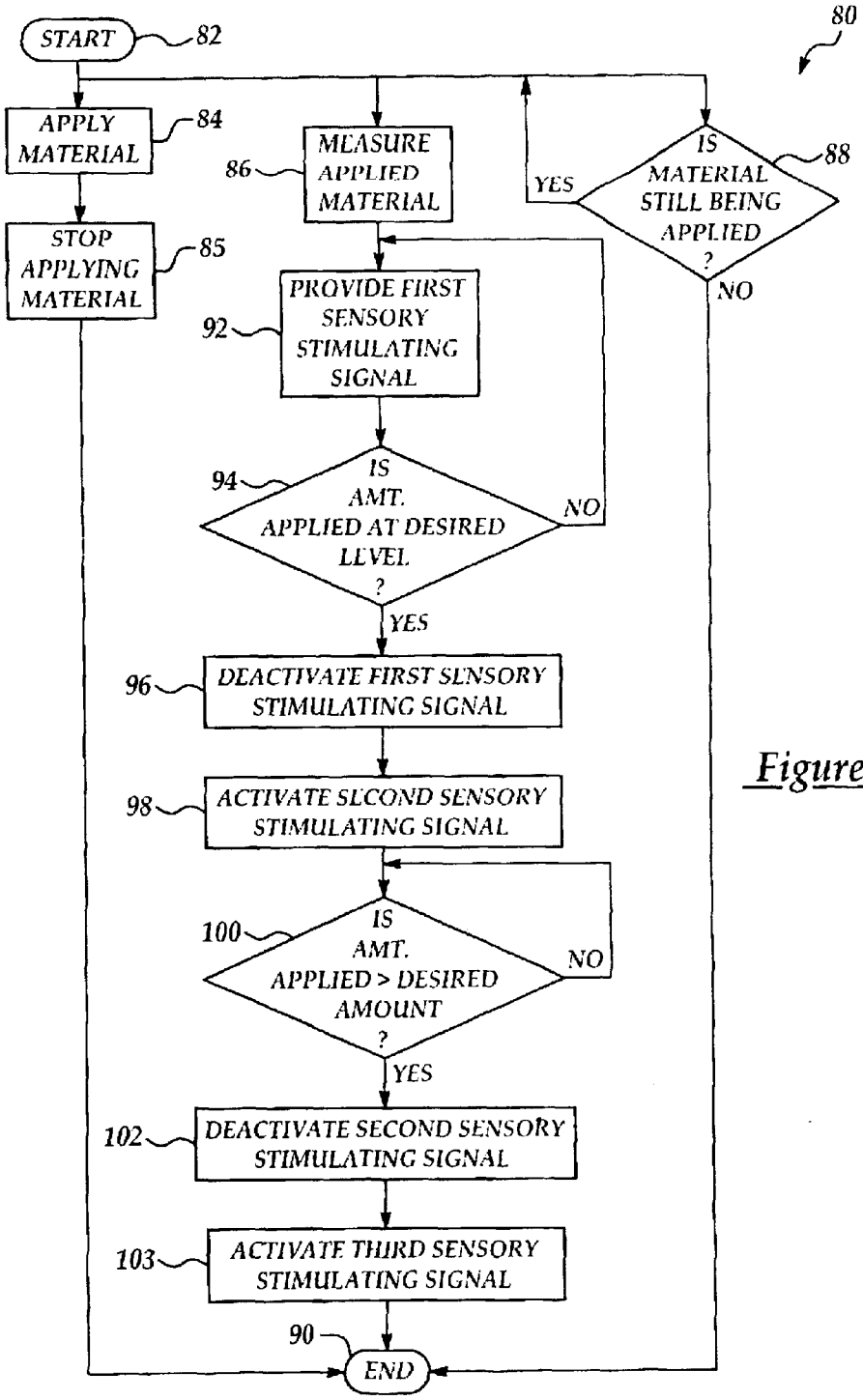
FIG. 3 is a flow chart which comprises the methodology of one non-limiting embodiment of the invention.

As shown best in FIG. 2, display assembly 38 includes annunciator face portion 60 having, in one non-limiting embodiment three selectively energizable lights 62, 64, and 66 which are respectively disposed alongside the phrases high volume, in tolerance, and low volume. In one non-limiting embodiment of the invention, the display assembly 38 further includes a selectively energizable or selectively activated speaker or noise generator assembly 70 which is also operatively disposed upon the annunciator face portion 60 and which is coupled to the controller 30 by bus 40. Further, display assembly 38, in yet another non-limiting embodiment of the invention, includes a data display portion 72 which is disposed upon the annunciator face portion 60 and which is coupled to the controller 30 by the use of bus 40. Moreover, each of the selectively energizable lights 62, 64, and 66 are coupled to the controller 30 by the bus 40. The operation of the error reduction assembly 10 in combination with the material dispensation assembly 12 will now be discussed in greater detail below. Referring now to FIG. 3, there is shown a flow chart or methodology 80 which comprises the methodology of the preferred embodiment of the invention. Particularly, the methodology 80 includes a first step 82 which denotes the start or the initiation of the process or methodology 80. In this step, the pump 16 causes the material 22 to flow or be communicated from the supply 14 to the gun 20 by activating the pump 16. Particularly, the material 22 travels through the pressure regulator 18 and the flow meter 32, before reaching the gun 20.

Step 82 is followed by steps 84, 86, and 88 in which the following respective actions or functions occur: material 22 is deposited upon the object 23 by the gun 20, the flow meter 32 measures the amount of material 22 being deposited upon the object 23 by the gun 20 (e.g., the amount of material 22 which traverses the flow meter 32) and communicates this information to the controller 30 by the use of bus 31, and the controller 30 determines whether material 22 is still being applied to the object 23 (e.g., whether flow type information continues to be provided to the controller 30). In the most preferred embodiment of the invention, the flow meter 32 continually measures the material 22 which is deposited upon the part 23 and communicates this information to the controller 30. Particularly, in one non-limiting embodiment, in step 84, the controller 30 continues to allow electrical energy to be sourced from the battery 33 (or another source of electrical energy) to the pump 16, thereby allowing at least a portion of the material 22 to be communicated to the gun 20. Step 85 follows step 84 in which a subsequent interruption of such energy (caused by a depression of a switch (not shown) upon the pump 16) prevents the material 22 from being communicated to the gun 20. The material 22 is therefore prevented from being applied to object 23. Step 90 follows step 85. If the controller 30 determines that material 22 is no longer being provided to the object 23, step 88 is also followed by step 90 in which the methodology 80 is stopped or terminated. Alternatively, if the material is still being applied to the object 23, the controller 30 remains in steps 84, 88. In another non-limiting embodiment, a rest or termination switch (not shown) may be deployed upon the face 60 and, when depressed, causes the methodology 80 to terminate (e.g., material 22 is prevented from being deposited upon the part 23).

Step 86 is followed by step 92 in which the controller 30 provides a first sensory stimulation signal by sourcing electrical energy from the battery 33 to the light 66, through controller 30 and busses 35, 40, thereby energizing the light 66 and causing the light, in one non-limiting embodiment of the invention, to emit a red color indicating that a low amount of material 22 has been deposited upon the object 23. When the operation begins, the light 66 is energized since material 22 just begins to be deposited upon the object 23. Step 92 is followed by step 94 in which the controller 30 determines, from the data supplied from the flow meter 32, whether the amount of material 22 which has been applied to the object 23 is at a desired level. Such a "desired level" or "alarm point" may be programmably placed into the controller 30. If the desired level of deposited material has not been reached, step 94 is followed by step 92. Alternatively, step 94 is followed by step 96 in which the controller 30 deactivates the selectively energizable light 66 by preventing electrical energy from being communicated to the light 66. Step 98 follows step 96 and, in this step 98, the controller 30 sources electrical energy from the battery 33 to the selectively energizable light 64, by use of busses 35, 40, effective to cause the light 64 to be energized and, in one non-limiting embodiment of the invention, to emit a green light. In one non-limiting embodiment of the invention, the steps 96 and 98 may concurrently occur.

Step 98 is followed by step 100 in which the controller 30 determines, from the data supplied by the flow meter 32, whether the amount of material 22 which has been applied to the object 23 exceeds the desired amount. If the desired amount has not been exceeded, the controller 30 continues to remain in this step 100. Alternatively, step 100 is followed by step 102 in which the light 66 is de-energized since the controller 30 interrupts the communication of electrical power from the battery 33 to the light 66. Step 102 is followed by step 103 in which the controller 30 provides a third sensory stimulation signal by energizing the light 62, indicating that an amount of material 22 has been placed upon the object 23 which exceeds the desired and pre-programmed amount. Such a "pre-programmed amount" may be defined by a first lowest desired value or amount and a second highest desired value or amount. In one non-limiting embodiment of the invention, steps 102 and 103 may be concurrently accomplished. Step 103 is followed by step 90. Hence, it should be realized that the controller 30, in this non-limiting embodiment, continually monitors, by the use of flow meter 32, the amount or volume of material 22 which is being deposited upon the part 23 in order to continually provide visual stimulation data to an operator who is utilizing the gun 20 to deposit material 22 upon the part 23, thereby providing continual positive visual feed back to the operator indicating the manner in which the operation is proceeding. In this manner, the operator may be easily and quickly trained to continually perform the operation in a desired manner.

In other non-limiting embodiments of the invention, the data which is received from the flow meter 32 is displayed and continually updated upon the data display portion 72 of the screen or annunciator 60, thereby allowing a process engineer or other individual to continually monitor and view the overall process. Further, in yet another non-limiting embodiment of the invention, the speaker or noise generation assembly 70 is activated, by receiving electrical energy from the battery 33 through the controller 30 and busses 35, 40, each time that one of the lights 62, and 66 is activated and that, in yet another non-limiting embodiment, the speaker or noise generation assembly 70 is adapted to generate a unique sound for each energized light 62, 66, thereby allowing an operator to determine whether the material has been deposited in a proper manner upon the object 23 by use of only the speaker assembly 70 (e.g., by use of only audible stimulus). In one alternate embodiment, the noise generation assembly 70 is also activated, effective to generate a unique sound, when the light 64 is energized. The guide or guard member 50 ensures that the gun 20 (the nozzle 21) is correctly placed upon a certain target "location" of the object 23 and at a certain distance from the target location, in order to achieve a desired deposit of material 22 upon the part 23, thereby allowing the assembly 10 to also provide a tactile stimulus.

In another non-limiting embodiment of the invention, face portion 60 includes a symbol 140 which comprises a picture of the object 23 which is to receive the material 22 along with a picture or symbol 141 of the material 22 in a properly disposed manner. The face portion 60 may also include the highest allowable or desirable material deposition value, the lowest allowable or desirable material deposition and the target amount of material to be deposited on the object. Hence, the lowest desired amount of material and the highest desired amount of material comprise alarm points which are used by the controller 30, in the foregoing manner, to energize lights 62–64 and assembly 70. The alarm points, as well as the optimal or desired material deposition amount, used by the controller 30, are also dynamically adjustable by an operator and the methodology 80 may also be dynamically modified in order to be used in a non-continuous operation.

That is, in the most preferred embodiment of the invention the controller 30 measures, by use of the data emanating from the flow meter 32 and communicated to the controller 30 by use of bus 31, the amount of material which has been deposited at some predetermined period of time (e.g., about five seconds) after the gun 20 is "released" or deactivated (e.g., material flow is stopped). Depending upon the measurement, the controller 30 then selectively performs the various previously delineated operations/functions (e.g., should the amount of deposited material 22 be below the lowest threshold level, the controller 30 energizes the light 66, should the amount of deposited material 22 be above the highest threshold level the controller 30 energizes the light 62, and should the amount of deposited material 22 reside within the allowable limit, the controller 30 energizes the light 64). Moreover, the forgoing process allows an operator to dynamically correct or adjust their method, procedure, and/or operation for the next part or object, so as to create an "in-specification" part or object by adjusting the speed or rate of material application. The foregoing process allows an operation to correct the amount of material deposited upon an existing part or object 23 if it were above and/or below the specification by selectively removing or adding material 22 as deemed necessary by the operator to provide a desired or "in-specification" part. The foregoing process may be used as part of any operation including but not limited to non-material deposition operations.

It is to be understood that the invention is not limited to the exact construction or method which has been illustrated and discussed above, but that various changes and modifications may be made without departing from the spirit and the scope of the invention as is delineated in the following claims. Moreover, it should be appreciated that the material dispensation assembly 12 in combination with the error reduction assembly 10 cooperatively comprises a new and novel material dispensation assembly, and that the error reduction assembly 10 dynamically ascertains the manner in which a certain operation is being performed and continually provides several feedback signals indicative of such dynamic monitoring. Moreover, these feedback signals comprise tactile, visual, and audio feedback signals which allow an operator to quickly learn how to perform an operation in a desired manner and which further allow operators having various types of dysfunction (e.g., a hearing loss to failure) to desirably perform a function or an operation in a consistent and desired level. Further, it should be appreciated that the error reduction assembly 10 may be used within substantially any desired operation or process and that the assembly 10 is adapted to provide positive feedback, effective to allow operators of the operation or process to quickly and efficiently learn to perform the operation or process in a desired manner. In another non-limiting embodiment, a real time data link or network is communicatively coupled to the controller 30, and allows to communication with the controller 30 and the gathering of data or the pertinent process information from the controller 30.

What is claimed is:

1. A system for dispensing a material onto a work piece, comprising:

a material contained in a supply source;

a pump in fluid flow communication with the supply source that provides the material to a fluid circuit;

a pressure regulator connected to the fluid circuit that receives material from the pump and regulates the pressure of the material in the fluid circuit;

a flow meter connected to the fluid circuit down stream of the pressure regulator, the flow meter measuring the amount of material flowing through the fluid circuit;

a manually controlled applicator that is controlled by an operator to dispense the material onto the workpiece;

the flow meter generating a quantity signal that is representative of the quantity of material measured by the flow meter; and a controller that receives the quantity signal and produces a display output signal within a predetermined amount of time after the operator stops dispensing material onto the work piece, the display output signal is received by a display device that provides an output that may be perceived by the operator that indicates whether the quantity of material dispensed is within a predetermined tolerance range, the operator being provided with a positive indication when the quantity of material dispensed is within the tolerance range.

2. The system of claim 1 wherein the work piece is a part of a vehicle.

3. The system of claim 1 wherein the manually controlled applicator is a gun that is used to dispense the material.

4. The system of claim 1 wherein the display device has a first light that indicates an excess volume condition, a second light indicating an in tolerance condition, and a third light indicating a low volume condition.

5. The system of claim 1 further comprising an audible signal generator being actuated as a positive indication when the quantity of material dispensed is within the tolerance range.

6. The system of claim 1 further comprising a visual data display screen that provides a visual depiction representative of the quantity of material dispensed.

7. The system of claim 1 wherein the material dispensed is an adhesive.

8. The system of claim 1 wherein the output provided by the display device is used to provide a positive feedback signal that is used to allow the operator to perform an operation with the manually controlled applicator in a desired manner.

9. The system of claim 1 wherein the output provided by the display device is used to provide an alarm signal that is used to indicate that the operator failed to perform an operation with the manually controlled applicator in a desired manner.

* * * * *